United States Patent [19]

Sutor et al.

[11] Patent Number: 4,909,484

[45] Date of Patent: Mar. 20, 1990

[54] PREVENTION OF SLAG BUILDUP IN STEEL LADLES

[75] Inventors: Peter T. Sutor, Pittsburgh; Edward L. Erny, Bethel Park, both of Pa.

[73] Assignee: Dresser Industries, Inc., Dallas, Tex.

[21] Appl. No.: 292,924

[22] Filed: Jan. 3, 1989

Related U.S. Application Data

[63] Continuation-in-part of Ser. No. 227,556, Aug. 2, 1988, abandoned.

[51] Int. Cl.[4] ..... C21C 5/44

[52] U.S. Cl. ..... 266/44; 266/280; 266/275

[58] Field of Search ..... 266/280, 275, 44; 501/89, 131, 130

[56] References Cited

U.S. PATENT DOCUMENTS 3,463,648 8/1969 Thompson ..... 501/131
3,992,214 11/1976 Petrak et al. ..... 501/89
4,570,910 2/1986 Geisler ..... 266/280

FOREIGN PATENT DOCUMENTS 0125659 7/1983 Japan ..... 266/280
0910556 3/1982 U.S.S.R. ..... 501/131

*Primary Examiner*—S. Kastler
*Attorney, Agent, or Firm*—Sigalos, Levine & Montgomery

[57] ABSTRACT

An improved ladle especially adapted for holding molten metals such as steel, the ladle having an interior brick lining a major part thereof which consists essentially of a composition of from about 70 to 95 weight percent of an aluminous material having a minimum alumina content of about 60 weight percent and the balance refractory clay; and for each 100 parts by weight of said composition, from about 5 to 20 weight percent of fine silicon carbide.

20 Claims, 2 Drawing Sheets

PREVENTION OF SLAG BUILDUP IN STEEL LADLES

BACKGROUND OF THE INVENTION

This is a continuation-in-part application Ser. No. 227,556 filed Aug. 2, 1988, now abandoned.

The present invention relates to preventing slag buildup on the inside of ladles such as those that are used to hold and treat molten steel.

In steel making, adles are used to hold, treat and/or transport steel; and during the course of such processing there is a slag buildup on the inside of the ladles. Thus, for example, with aluminum-killed steel, there is a reaction with conventional high alumina brick used to line the ladles, and an oxide deposit forms. Such deposits are detrimental in many ways, including, particularly, the reduction of effective ladle capacity. After a number of heats, as the slag buildup increases, it is possible to get ten inches or more buildup in the lable which greatly reduces its capacity. Also, as more batches are processed in the ladle there is often erosion of the accumulated slag buildup resulting in reentry of portions of the slag into the molten steel, thus adversely affecting its quality. Similar problems have occurred in drains or pouring channels used to conduct molten metal from the ladles.

As a consequence of the foregoing there has been a need to replace the lining after 30 to 40 melts or in some instances, even sooner when the slag buildup becomes excessive.

Efforts to overcome this problem have included using either high alumina brick containing 70 to 80 percent alumina, brick modified by the addition of tar impregnation or zircon brick. All of these have been deficient for various reasons. Of the foregoing, the best may be the zircon brick. However, zircon brick is very costly. Accordingly, there previously has been no low cost efficient refractory which has been used to line the inside of ladles and ladle pouring nozzles and effectively retard the aforementioned slag buildup.

SUMMARY OF THE INVENTION

The present invention overcomes the problems associated with brick previously used and prevents excessive slag buildup while achieving low cost.

Briefly, the present invention comprises an improved low slag buildup ladle and the method of preventing slag buildup on the inside of a ladle used to hold or treat molten steel. It further comprises an improved low slag buildup nozzle for use in the improved ladle. In accordance with the invention, there is applied to at least the barrel section of a ladle a burned refractory shape comprised of about 75 to 95 weight percent of an aluminous material having a minimum alumina content of about 60 weight percent and the balance refractory clay and for each 100 parts by weight of said material from about 5 to 20 wt. percent of fine silicon carbide. It also includes a similar composition lining for pouring nozzles in embodiments wherein pouring nozzles are used.

Preferably there is utilized a refractory brick having 75 to 95 weight percent of aluminous material having an aluminum content of 70 to 85 weight percent. Accordingly, the invention contemplates the utilization of a refractory composition comprising from about 70 to 95 weight percent of an aluminous material having a minimum alumina content of 70 weight percent and the balance refractory clay and for each 100 parts by weight of such composition from about 5 to 20 wt. percent—65 mesh silicon carbide.

DETAILED DESCRIPTION

The present invention is useful with steel ladles, regardless of their particular shape or whether they are used for merely holding molten steel, transporting steel or for treating molten steel. Ordinarily, steel ladles are semicylindrical in shape and have either a flat or a rounded bottom. They may also include or exclude a pouring aperture or nozzle.

The method of the present invention can be utilized to line entire ladles and pouring nozzles or only selected portions, depending upon the desire of the particular steel-making facility and their experience in determining where their slag problem is most critical.

Figure 1:
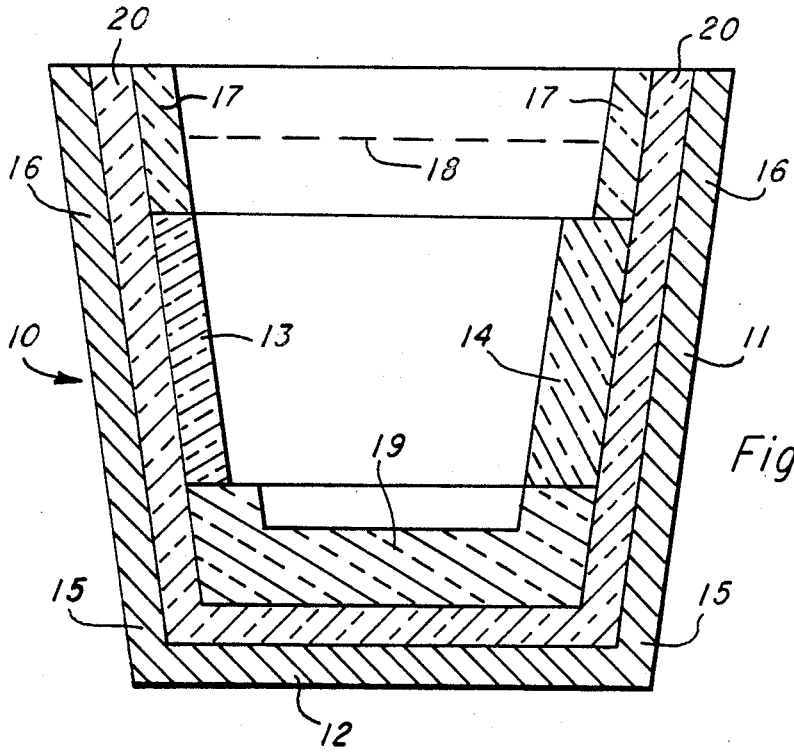
FIG. 1 shows a cross-sectional view of the preferred embodiment of a steel ladle containing refractories in accordance with the present invention.

Referring to FIG. 1, there is shown in cross section a steel ladle 10 having main supporting side walls 11 (the central portion being hereinafter referred to as the "barrel") and a bottom 12 made of any suitable material such as steel. On the exterior of the side walls, there may be mounted one or more known handling accessories (not shown) such as steel ears or eyes to which lifting, supporting, transporting and/or swiveling equipment may be detachably or permanently attached. In addition, the upper portion may include one or more pouring spouts or the like.

Immediately adjacent to and in contact with the interior of side walls 11 and bottom 12 is a conventional safety lining or intermediate safety layer 20. This layer 20 may be constructed in accordance with known customary techniques and typically exhibits a quality of 40 to 60 percent alumina.

Lining the lower barrel of ladle 10 is a layer 13 of a special high alumina refractory material (hereinafter described in greater detail) having a minimum of about 60 percent by weight of aluminous material, and preferably from about 65 to 95 weight percent alumina, and the rest refractory clay and for each 100 parts by weight of said material from about 5 to 20 wt. percent of fine silicon carbide. This lower lining is formed of small bricks or other segments that are installed within the ladle and adhered to the safety lining thereof by conventional adherents (not shown). Illustrative of such conventional adherent is any conventional mortar used in the construction of ladle linings.

Layer 19 is shown as extending over the bottom 12 of the ladle and is of zircon quality material. It should be noted that the bottom 19 may be lined with many other suitable conventional materials as known to those skilled in the art. One preferred composition is that having a minimum of about 60 weight percent of an aluminous material; and the rest refractory clay.

Also within lable 10 is splash plate 14 which is conventional and made of any suitable refractory material such as, for example, precast alumina shapes or 80 to 85 weight percent alumina brick. One suitable example of a brick is that sold under the product designation KRIAL 80 HS by National Refractories Company. As will be evident to those skilled in the art, the splash plate is included to provide a special abrasive resistant surface to receive and withstand the impact and wear that unavoidably accompany the pouring of molten steel into the ladle.

In the depiction shown, refractories are illustrated as being utilized throughout the entire interior of the ladle, with the ladle shown to be divided into a bottom portion 12, a skirt portion 15, the barrel portion 11, and the slagline portion 16.

It has been found that slag wear is particularly troublesome at or near the upper surface of the molten metal, e.g., such as at slagline 18. Accordingly, a material somewhat different from that of layer 13 is preferably employed to line slagline region 17. Region 17 is comprised of materials having a high percentage of magnesite.

In some instances, the percent invention is utilized only with the barrel sections of ladles since it is in that area where the greatest slag buildup occurs, thereby resulting in the aforementioned reduced capacity of the ladle and flaking off of slag which can adversely affect the steel quality.

The shape of the refractories utilized is preferably that of brick. As described above, bricks 13 are made from compositions having a minimum of 60 weight percent alumina; most preferably from 70 to 95 weight percent alumina and the balance refractory clay, and for each 100 parts by weight of such composition, a predetermined amount of silicon carbide. The alumina material is preferably bauxite, since bauxite provides the highest level of alumina. The refractory clay can be ball clay, preferably air floated.

To impart the aforementioned desirable characteristics to bricks 13, there is added for each 100 parts by weight of the mixture of the aluminous material and the clay, from about 5 to 20 weight percent of fine silicon carbide, preferably −65 mesh. This composition is then formed into bricks using conventional brick molding techniques, and the resultant bricks are then burned at a high temperature about 2400° F., before being installed in the ladle.

The invention will be further described in connection with the following examples which are set forth for purposes of illustration only.

EXAMPLE 1

A ladle having a top diameter of approximately 132 inches, an interior depth of about 150 inches, and a bottom interior diameter of about 93 inches was thoroughly cleaned of used refractory. The bottom interior surface was then lined with refractory brick identified and sold under the name "Zircor". This Zircor brand brick is a high zirconium content refractory having the following approximate composition and characteristics: $SiO_2$, 33.2%; $Al_2O_3$, 9.4%; $TiO_2$, 0.4%; $Fe_2O_3$, 0.2%; $Cr_2O_3$, 0.2%;; and $ZrO_2$, 56.4%. These appear in mineral phases of zircon ($ZrO_2 \cdot SiO_2$); mullite ($3Al_2O_3 \cdot 2SiO_2$); and cristobolite ($SiO_2$).

The Zircor brand refractory was adhered to the interior bottom of the ladle by refractory mortar adhesive which was applied to the adhering sides of the bricks and the interior bottom surface of the ladle.

In addition to covering the bottom, the Zircor refractory bricks were similarly installed for a distance of approximately 9 inches vertically, measuring from the top surface of the bottom brick, thus covering the aforementioned skirt portion.

Next, the interior of the barrel portion was lined. For this purpose, bricks of high alumina refractory material with silicon carbide (as described above) were used and were adhered to the interior walls of the ladle over a surface area beginning where the Zircor brand refractory bricks stopped and continuing upwardly to a level approximately 48 inches from the ladle top. These high alumina refractory bricks had the following composition: about 80 weight percent high alumina calcines, about 10 weight percent ball clay, and about 10 weight percent silicon carbide.

A splash wall (impact pad) was also installed in the barrel portion in the central part of the lower wall. KRIAL 80 HS (as described above) was used. It measured approximately 9 inches in thickness and 48 inches in width and extended to within about 48 inches of the ladle top.

Lastly, the slagline refractories were installed. These were installed on the ladle surface lining inner surfaces beginning at the termination of the barrel refractories and extending upwardly to the ladle top. These slagline refractories were bricks made of magnesite and chromic oxide. Such a composition is sold by DIDIER/TAYLOR Refractories and is called "REXAL 4NA."

The entire ladle was then conditioned by preheating to approximately 2,000° F.

Next, the ladle was tested in the following manner: approximately 150 tons of carbon steel at approximately 2,950° F. was tapped into the ladle and treated for approximately 60 minutes at an argon lance station for stirring to render the steel uniform in temperature and chemical constituency.

It was transferred to the caster and then cast for 75 minutes. After emptying, the ladle was refilled for 28 batches and then carefully examined. There was essentially no slag buildup except for the splash wall (impact pad) section where the buildup was modest.

EXAMPLE II

Two ladles of similar dimensions to those of the ladle of Example I were lined with conventional materials including safety linings 20 of material similar to that of Example I. The material of interior bottoms 19 was 80 percent high alumina brick. However, the layers 13 were different in that they were of 70 percent alumina brick. After a similar number of heats for each of these two ladles, they were inspected and found to have from 2 to 5 inches of slag buildup, a very undesirably high level.

Figure 2:
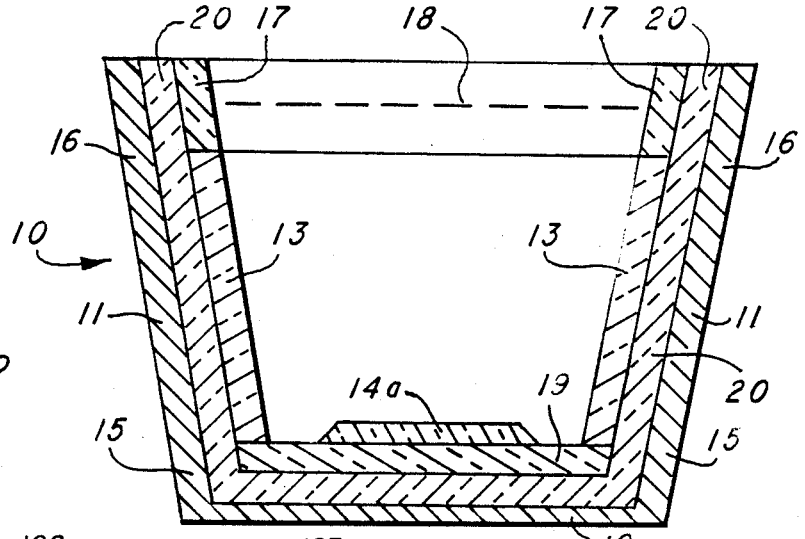
FIG. 2 is a cross-sectional view of an alternate embodiment.

Now turning to FIG. 2, it will be observed that it depicts an alternate ladle configuration in which the impact pad (splash plate) **14*a* is mounted centrally in the bottom interior of the ladle; and in which the wall portion 13 extends entirely around the barrel part 11. The compositions of the materials are similar to those described for the corresponding regions of FIG. 1. Moreover, it should be noted that although the splash plate (impact pad) 14*a* is shown as being atop layer 19, it may, in some instances project partly or entirely through layer 19 and contact safety lining 20**.

Figure 3:
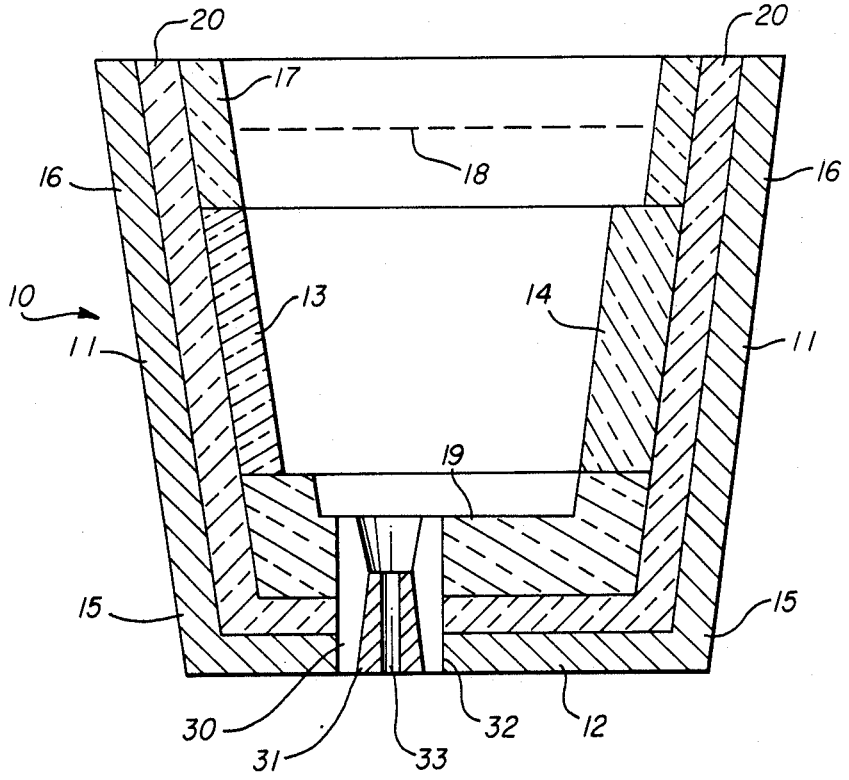
FIG. 3 is a cross-sectional view of another alternate structure in which there is located a combination pocket block/pouring nozzle in the bottom thereof.

FIG. 3 illustrates a ladle similar to that of FIG. 1 except for the addition of a pocket block 30 and nozzle 31 which are included to provide for draining the ladle.

As is shown in the Figure, an aperture having a wall 32 is extended vertically through bottom 12, intermediate safety layer 20 and refractory layer 19. Mounted within this aperture is pocket block 30 which is of material similar to that of layer 19; and fitted within pocket block 30 is nozzle 31 which is of material similar to that of slagline region 17. A conventional plug or gate valve structure (not shown) is used to prevent exit of molten metal through aperture 33 of nozzle 31 unless and until desired by the ladle operator.

Figure 4:
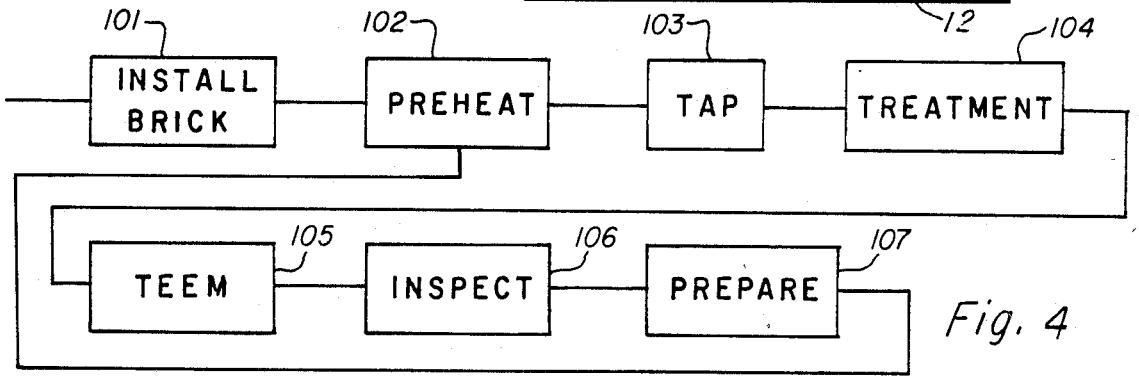
FIG. 4 is a flow diagram depicting steps in the method of practicing the invention.

FIG. 4 depicts the principal steps employed in carrying out the method according to the invention. The first step (101) is the installation of the refractory materials. This is followed by a preheating (102) of the ladle to about 2,000° F. Next, a batch of molten steel is tapped (103) and introduced into the ladle. This is then followed by treatment (104) of the molten steel to evenly distribute the constituents thereof and to make the temperature essentially uniform therethrough. Next, the metal is teemed, (105) i.e., emptied or drained from the ladle. After the ladle is emptied, it is inspected (106) and then prepared (107) by cleaning for the next batch.

While the invention has been described in connection with a preferred embodiment, it is not intended to limit the scope of the invention to the precise form set forth, but, on the contrary, it is intended to cover such alternatives, modifications, and equivalents as may be included within the spirit and scope of the invention as defined by the appended claims.

What is claimed is:

1. The method of preventing slag buildup on the inside of a ladle having an interior slagline section, an interior bottom and an interior barrel section exposed to molton steel comprising applying to at least a portion of the ladle exposed to said steel refractory lining composition, said lining composition consisting essentially of from about 75 to 95 weight percent of an aluminous material having a minimum alumina content of about 60 weight percent and the balance refractory clay and for each 100 parts by weight of said composition from about 5 to 20 weight percent of fine silicon carbide.

2. The method according to claim 1 wherein said lining is applied to the entirety of said interior barrel section of said ladle.

3. The method according to claim 1 in which said ladle includes metal exit means in the lower portion thereof and wherein said lining is applied to said metal exit means.

4. The method according to claim 2 further including applying to said interior bottom of said ladle a layer of high zirconium content refractory.

5. The method according to claim 3 further including applying to said interior bottom of said ladle a layer of high zirconium content refractory.

6. The method according to claim 2 further including applying to said interior bottom of said ladle a layer having a minimum of about 60 percent by weight of aluminous material and the rest refractory clay.

7. The method according to claim 3 further including applying to said interior bottom of said ladle a layer having a minimum of about 60 percent by weight of aluminous material and the rest refractory clay.

8. The method according to claim 2 further including applying to said interior slagline section of said ladle a layer of high magnesite content refractory.

9. The method according to claim 3 further including applying to said interior slagline section of said ladle a layer of high magnesite content refractory.

10. The method according to claim 6 further including applying to said interior slagline section of said ladle a layer of high magnesite content refractory.

11. The method according to claim 7 further including applying to said interior slagline section of said ladle a layer of high magnesite content refractory.

12. The method according to claim 2 further including applying to said interior bottom of said ladle a layer of high zirconium content refractory and to said interior slagline section of said ladle a layer of high magnesite content refractory.

13. The method according to claim 3 further including applying to said interior bottom of said ladle a layer of high zirconium content refractory and to said interior slagline section of said ladle a layer of high magnesite content refractory.

14. An improved ladle adapted for molten ferric materials comprising:

(a) a main exterior housing having a bottom and sidewalls connected to said bottom and extending upwardly to form a receptacle, said receptacle having an opening at the upper portion thereof;

(b) a first refractory material comprising a safety layer lining the interior of said main exterior housing;

(c) a second refractory material comprising high zirconium content refractory lining the bottom interior of said safety lining;

(d) a third and different refractory material lining at least a major portion of the interior upwardly extending sidewalls of said safety lining, said third and different refractory consisting essentially of a composition having from about 70 to 95 weight percent of an aluminous material having a minimum alumina content of about 60 weight percent and the balance refractory clay, and for each 100 parts by weight of said composition, from about 5 to 20 weight percent of fine silicon carbide; and (e) a fourth refractory material lining a predetermined portion of the interior surface of said safety lining of said ladle, said predetermined portion including the slagline of said ladle.

15. An improved ladle according to claim 14, further including a fifth refractory material disposed in and adhered to a predetermined portion of the interior sidewall of said safety lining, said fifth refractory material being specially adapted for withstanding the impact of molten material poured into said ladle.

16. An improved ladle according to claim 14 in which said fine silicon carbide is −65 mesh.

17. An improved ladle according to claim 14 further including within the lower part thereof, a metal exit port extending from the interior to the exterior of said ladle, and wherein the metal contacting surface of said metal exit port is lined with an anti-slag refractory.

18. An improved ladle according to claim 17 in which said anti-slag refractory is said fourth refractory material.

19. An improved ladle according to claim 15 further including within the lower part thereof, a metal exit port extending from the interior to the exterior of said ladle, and wherein the metal contacting surface of said metal exit port is lined with an anti-slag refractory.

20. An improved ladle according to claim 19 in which said anti-slag refractory is said fourth refractory material.

* * * * *